US007073925B2

(12) United States Patent
Stekelenburg

(10) Patent No.: US 7,073,925 B2
(45) Date of Patent: Jul. 11, 2006

(54) PROTECTIVE GRID FOR WORK LIGHT

(75) Inventor: Albert Stekelenburg, Taipei (TW)

(73) Assignee: All-Line Inc., Taipei (TW)

( * ) Notice: Subject to any disclaimer, the term of this patent is extended or adjusted under 35 U.S.C. 154(b) by 0 days.

(21) Appl. No.: 10/722,605

(22) Filed: Nov. 28, 2003

(65) Prior Publication Data

US 2005/0117353 A1 Jun. 2, 2005

(51) Int. Cl.
*F21V 21/00* (2006.01)

(52) U.S. Cl. ..... 362/376; 362/457; 362/400

(58) Field of Classification Search ..... 362/376, 362/362, 457, 458, 400; D26/63, 60, 119
See application file for complete search history.

(56) References Cited

U.S. PATENT DOCUMENTS

| | | | | |
|---|---|---|---|---|
| 5,195,823 | A * | 3/1993 | Sidabras | 362/387 |
| 5,243,507 | A * | 9/1993 | Atkins et al. | 362/376 |
| 5,660,464 | A * | 8/1997 | Lin | 362/376 |
| D419,709 | S * | 1/2000 | Spitler | D26/63 |
| 6,050,710 | A * | 4/2000 | Grossman et al. | 362/427 |
| 6,328,460 | B1 * | 12/2001 | Grossman et al. | 362/427 |

* cited by examiner

*Primary Examiner*—Thomas M. Sember
(74) *Attorney, Agent, or Firm*—Troxell Law Office, PLLC

(57) ABSTRACT

A protective grid of a work light located on a rear portion of a main body of a halogen work light. The protective grid is spaced apart from the rear portion of the main body.

3 Claims, 3 Drawing Sheets

PROTECTIVE GRID FOR WORK LIGHT

BACKGROUND OF THE INVENTION

1. Field of the Invention

The present invention relates to a lighting device, specially to a work lamp with a grid adopted on a rear side thereof.

2. Description of the Prior Art

A work lamp or work light, specifically a lighting device having a halogen bulb or tube, is a conventional lighting instrument widely used indoors as well as outdoors, mainly for in a work place or a plant, for large space lighting. The reasons for using the halogen light bulb or tube are that it can produce a stronger light and is covered by a stiff outer shell.

FIG. 1 shows a conventional halogen work light including a main body A, on front side; a lamp, such as halogen bulb B adopted inside said main body A, and the back (rear) side C of said main body A, provided a wire box D which has electrical wires inside.

The rear side C of the above-mentioned main body A always produces heat. Under the high temperature, to those people who repairing, maintenance, as well as working nearby, a risk is always present.

Certain working places always use the portable halogen work light as a lighting device. But because it can be hit by other articles, in order to prevent the arm caused by hit, the improvement normally is to increase the thickness of the shell of the rear portion or whole lighting device.

Up to now, the rear side of all halogen work light sold in marketplace is bare without any shielding, therefore, it is worthy for us to improve it.

SUMMARY OF THE INVENTION

The main object and purpose of the present invention is to provide a protective grid on a rear side of a halogen work light.

The protective grid including the connecting plate can be connected to the main body and has a plurality of grid rods.

The protective area of the protective grid allows the wire box to be accessed for installation, repair and maintenance.

The protective grid can be composed by vertical rods, horizontal rods, slope rods, netting rods and the like.

DETAILED DESCRIPTION OF THE PREFERRED EMBODIMENTS

Figure 1:
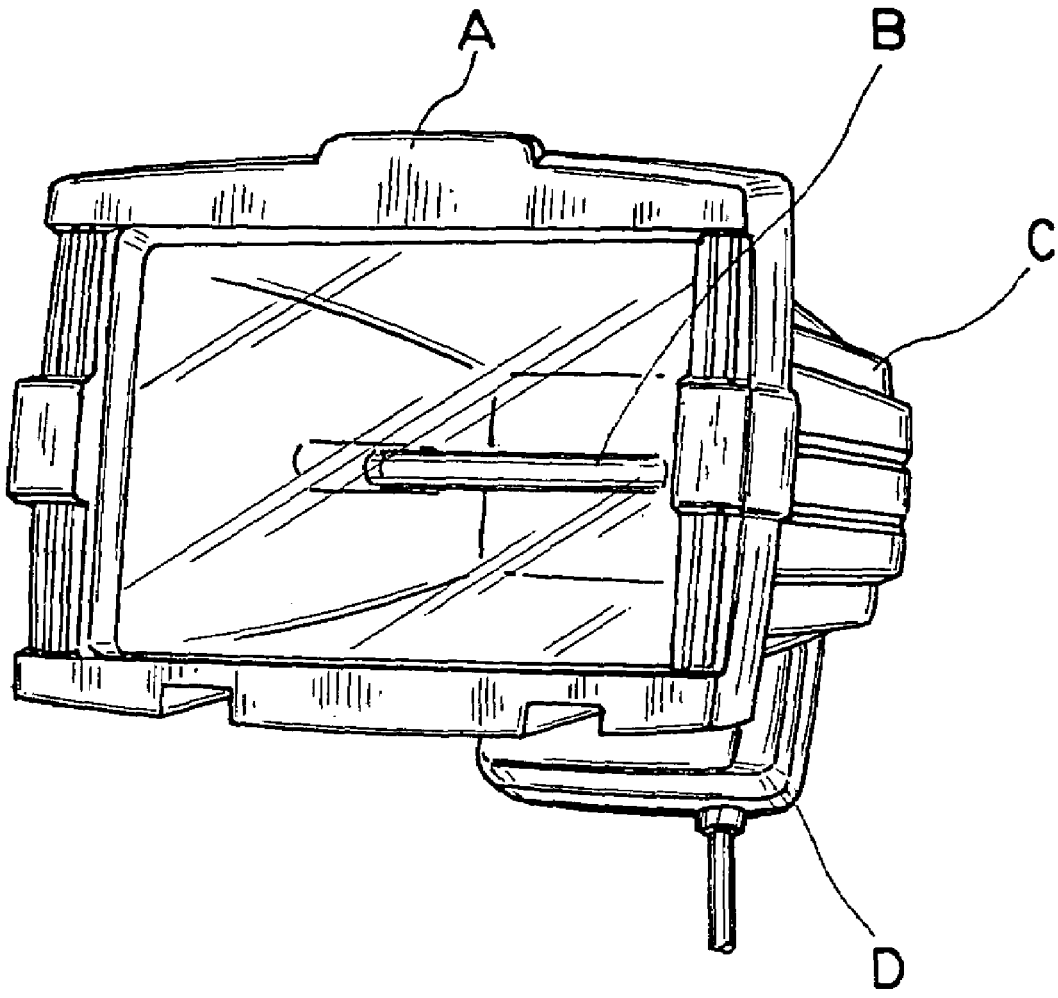
FIG. 1 (PRIOR ART)
FIG. 1 is the prospective view of the conventional halogen light.
Figure 2:
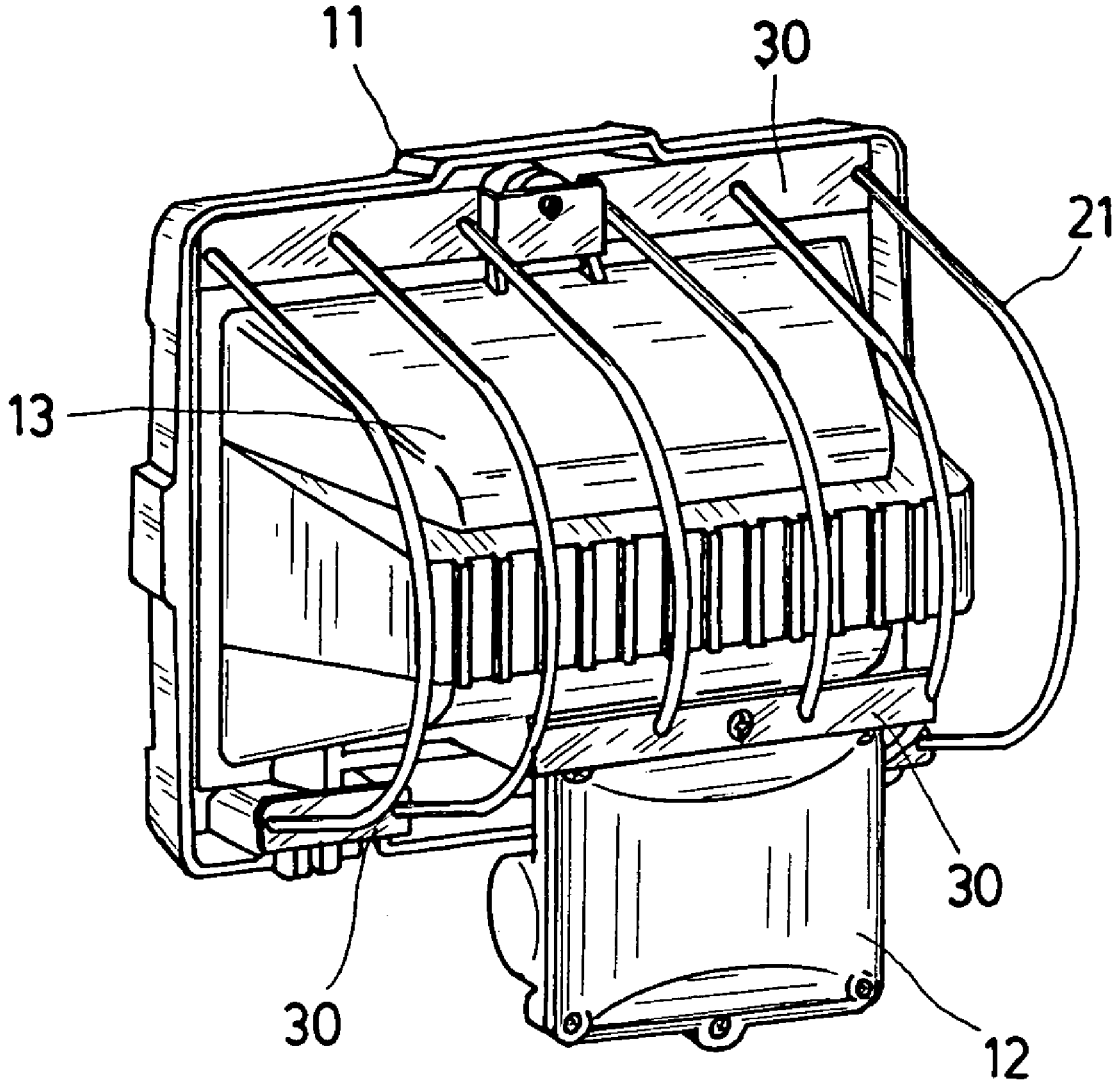
FIG. 2 is the rear prospective view of the main body of the present invention.
Figure 3:
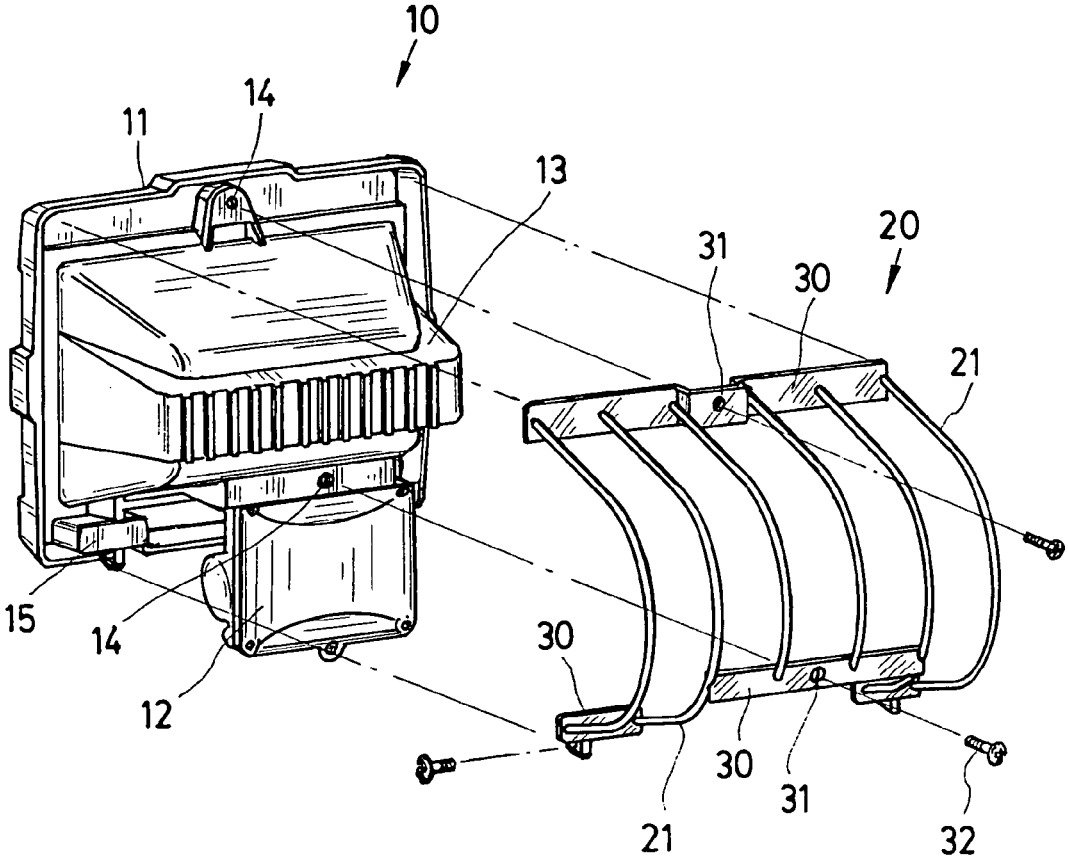
FIG. 3 is the prospective view of the main body and protective grid of the present invention.

Referring to FIGS. 2 and 3, the construction of the present invention includes a protective grid on a rear side of a main body 10, the protective grid has a grid body 20 and connecting plates 30 connected respectively.

The main body 10 is a conventional structure normally having a lamp body 11 and a wire box 12. The lamp body 11 further including a rear portion 13.

In the embodiment of the present invention, proper place around the rear portion 13, provides the connecting member for adopting said protective gird, such as screwing holes 14 and protrusion plate 15.

Grid body 20 constructed to cover the rear portion 13 of main body 10. The configuration can be by parallel grids rods, netting or crossed by horizontal and vertical rods. The rods 21 can be formed by bending and both opposing ends are fixed to the connecting plate 30.

The connecting plates 30 are a structure which can be connected to the rear portion 13 of the lamp body 11. As shown in drawings, the connecting plates 30 include holes 31 which correspond to screwing holes 14. The connecting plate can be connected using screws 32 to connect the grid body 20 with the lamp body 11.

Referring to the drawings, between the protective grid and rear portion 13, there are a plurality of gaps formed by the rods to prevent unnecessary contact with the rear portion 13. Even with the protective grid covering the rear portion 13, there is still an open space under the protective grid allowing the wire box 12 to be accessible.

Due to versatile shapes of the lamp body 11, the protective grid can be designed to comply with the rear portion of the lamp body.

The main body 10 of the work light can be adopted and fixed to the lamp frame as well as adopted as a portable unit.

The embodiment disclosed in the specification is only one of the examples. Any minor change or modification derived from the inventive concept of the present invention will still fall within the scope of the present invention.

What is claimed is:

1. A protective grid for a work lamp having a bulb projecting a light from a front portion of the work lamp, the protective grid comprising:

a) a plurality of plates connected to and covering a rear portion of the work lamp, the rear portion being located opposite the front portion; and b) a grid body connected to the plurality of plates.

2. The protective grid according to claim 1, wherein the grid body includes a plurality of grid rods connected at opposing ends thereof to the plurality of plates.

3. The protective grid according to claim 2, wherein the plurality of grid rods are arranged in a pattern selected from a group consisting of parallel rods located in a vertical direction, parallel rods located in a horizontal direction, crossing rods located in horizontal and vertical directions, and crossing rods located in non-horizontal and non-vertical directions.

* * * * *